United States Patent [19]

Hawkins et al.

[11] Patent Number: 4,951,063

[45] Date of Patent: Aug. 21, 1990

[54] HEATING ELEMENTS FOR THERMAL INK JET DEVICES

[75] Inventors: William G. Hawkins; Olaf Muller, both of Webster; James F. O'Neill, Penfield, all of N.Y.

[73] Assignee: Xerox Corporation, Stamford, Conn.

[21] Appl. No.: 354,941

[22] Filed: May 22, 1989

[51] Int. Cl.[5] ..... B41J 2/05

[52] U.S. Cl. ..... 346/1.1; 346/140 R; 437/241

[58] Field of Search ..... 346/140, 1.1; 437/241

[56] References Cited

U.S. PATENT DOCUMENTS

| | | | |
|---|---|---|---|
| Re. 32,572 | 1/1988 | Hawkins et al. | 156/626 |
| 3,503,798 | 3/1970 | Yoshioka | 437/241 |
| 3,615,940 | 10/1971 | Kang | 437/241 X |
| 4,259,564 | 3/1981 | Ohkubo et al. | 219/216 |
| 4,450,457 | 5/1984 | Miyachi et al. | 346/140 R |
| 4,513,298 | 4/1985 | Scheu | 346/140 R |
| 4,532,530 | 7/1985 | Hawkins | 346/140 R |
| 4,535,343 | 8/1985 | Wright et al. | 346/140 R |
| 4,567,493 | 1/1986 | Ikeda et al. | 346/140 R |
| 4,577,202 | 3/1986 | Hara | 346/140 R |
| 4,618,541 | 10/1986 | Forouhi | 437/241 X |
| 4,638,337 | 1/1987 | Torpey et al. | 346/140 R |

*Primary Examiner*—Joseph W. Hartary
*Attorney, Agent, or Firm*—Robert A. Chittum

[57] ABSTRACT

A thermal ink jet printhead is improved by a specific heating element structure and method of manufacture. The heating elements each have a resistive layer, a high temperature deposited plasma or pyrolytic silicon nitride thereover of predetermined thickness to electrically isolate a subsequently formed cavitational stress protecting layer of tantalum thereon. The pyrolytic silicon nitride permits wet chemical or dry plasma etching delineation of the tantalum without deleterious impact on the silicon nitride, while the delineated tantalum can serve as mask for the wet etch delineation of the silicon nitride. Because of the high deposition temperatures, the aluminum electrodes are patterned and passivated last. Such a construction lowers the manufacturing cost and concurrently provides a more durable printhead.

11 Claims, 3 Drawing Sheets

HEATING ELEMENTS FOR THERMAL INK JET DEVICES

BACKGROUND OF THE INVENTION

1. Field of the Invention

This invention relates to thermal ink jet printing devices and, more particularly, to improved bubble generating heating elements or transducers for thermal ink jet devices, which results in longer heating element lifetimes and a more cost effective manufacturing process.

2. Description of the Prior Art

Thermal ink jet printing is generally a drop-on-demand type of ink jet printing which uses thermal energy to produce a vapor bubble in an ink-filled channel that expels a droplet. A thermal energy generator or heating element, usually a resistor, is located in the channels near the nozzle a predetermined distance therefrom. The resistors are individually addressed with an electrical pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle while the bubble is growing provides the momentum and velocity of the droplet in a substantially straight line direction towards a recording medium, such as paper.

The environment of the heating element during the droplet ejection operation consists of high temperatures, thermal stress, a large electrical field, and a significant cavitational stress. Thus, the need for a cavitational stress protecting layer over the heating elements was recognized early, and one very good material for this purpose is tantalum (Ta), as is well known in the industry.

The previous art of using an electrically insulating layer between the heating elements and the Ta protecting layer, such as, for example, silicon dioxide or plasma deposited silicon nitride presents several problems. These problems include (1) the poor thermal conductivity of silicon dioxide or silicon nitride, so that the heating element must be much hotter than the Ta layer, making the heating element thermally inefficient, and (2) the fact that the delineation of Ta requires plasma etching in $CF_4/O_2$ mixtures. Unlike plasma etching of many other materials, the volatile gases evolved have low vapor pressure and are difficult to pump off. The Ta process is also very sensitive to moisture, both in the plasma etch chamber and in the Ta deposition chamber. The etch process sometimes leaves a residue which can result in poor aluminum (Al) addressing electrode adhesion to the heating elements as well as leading to wire bond failure at the Al electrode terminal interface.

The present inventive heating element structure and method of fabrication eliminates all of these problems, as discussed later. A review of the known prior art, such as identified below, recognized some problems with silicon dioxide and plasma deposited silicon nitride, such as life shortening pinholes and the like, but could not find adequate solutions.

U.S. Pat. No. 4,259,564 to Ohkubo et al discloses use of thin film manufacturing process to achieve improved resolution in integrated thermal printheads while retaining some less costly thick-film manufacturing processes to keep the over all printhead cost down. The printhead comprises a dielectric substrate, thick-film lead electrode layers with insulating means therebetween, thin-film resistive layers, thin-film lead electrode layers, and two protective overlayers; viz., an oxidation preventive film of $SiO_2$, $Al_2O_3$, or the like and a protective wear resistance layer made of $Ta_2O_5$, $Al_2O_3$, or the like covering the oxidation preventive film.

U.S. Pat. No. 4,450,457 to Miyachi et al discloses the use of a double passivation layer for the electrodes to prevent galvanic corrosion of electrodes caused by both pinholes in silicon dioxide sputtered layer used generally for passivation and by dielectric breakdown of the passivation between the Al electrodes and the tantalum cavitational protecting overlayer. The double passivation layer includes a layer of material such as an inorganic oxide or nitride (e.g., silicon dioxide or silicon nitride) and a second layer formed by plasma polymerization of various organic monomers as well as other methods of fabrication.

U.S. Pat. No. 4,577,202 to Hara discloses a double passivation layer for the electrodes wherein an organic passivation layer is formed over the inorganic passivation layer instead of the reverse order of passivation in U.S. Pat. No. 4,450,457.

U.S. Pat. No. 4,567,493 to Ikeda et al discloses a thermal ink jet printer similar to that of U.S. Pat. No. 4,577,202 except that the cavitational protective layer is only over the heating element.

U.S. Pat. No. 4,513,298 to Scheu discloses a thermal ink jet printhead employing a resistive element comprised of phosphorus-diffused silicon or polycrystalline silicon and a passivation structure including a layer of silicon nitride. The silicon nitride is formed by plasma enhanced chemical vapor deposition. An upper layer, the one in contact with the ink and on which the ink bubble collapses, is silicon carbide. This upper layer is formed on the lower silicon nitride passivating layer. Unfortunately, this passivation technique is not as free from defects such as pinholes and compromise protection of resistive elements and electrodes.

U.S. Pat. No. 4,535,343 to Wright et al reduces the pinhole problems of the U.S. Pat. No. 4,513,298 patent by using a resistive structure formed of tantalum nitride with electrical conductors of aluminum. The resistor structure between the electrical conductors is exposed and subjected to a reactive oxygen atmosphere. This results in the oxidation of the exposed surface portions of the aluminum conductors to anodize and form a surface film of $Al_2O_3$ thereon. At the same time the oxygen reacts with the exposed resistor structure to form a smooth defect-free passivation layer of tantalum pentoxide or tantalum oxynitride. Also disclosed is a thermal insulating barrier of silicon dioxide.

U.S. Pat. No. 4,532,530 to Hawkins discloses a thermal ink jet printhead having heating elements produced from doped polycrystalline silicon. Glass mesas thermally isolate the active portion of the heating element from the silicon supporting substrate and from electrode connecting points.

SUMMARY OF THE INVENTION

It is the object of the present invention to provide a thermal ink jet printhead having heating elements with longer operating lifetimes and greater thermal efficiency.

It is another object of the invention to provide a thermal ink jet printhead having heating elements with a structure which uses pyrolytic silicon nitride as the insulative layer between a resistive layer of polysilicon and a tantalum layer of the heating elements with the accompanying benefit that the pyrolytic silicon nitride is not attacked by the delineating Ta etches.

In the present invention, a thermal ink jet printhead is improved by a specific heating element structure and method of manufacture. The heating elements each have a resistive layer, a high temperature deposited pyrolytic silicon nitride thereover of predetermined thickness to electrically isolate a subsequently formed cavitational stress protecting layer of tantalum thereon. The polyrolytic silicon nitride permits etching delineation of the tantalum without deleterious impact on the silicon nitride, while the delineated tantalum can serve as mask for the wet etch delineation of the silicon nitride. Such a construction lowers the manufacturing cost and concurrently provides a more durable printhead.

A more complete understanding of the present invention can be obtained by considering the following detailed description in conjunction with the accompanying drawings wherein like parts have the same index numerals.

DESCRIPTION OF THE PREFERRED EMBODIMENT

Figure 1:
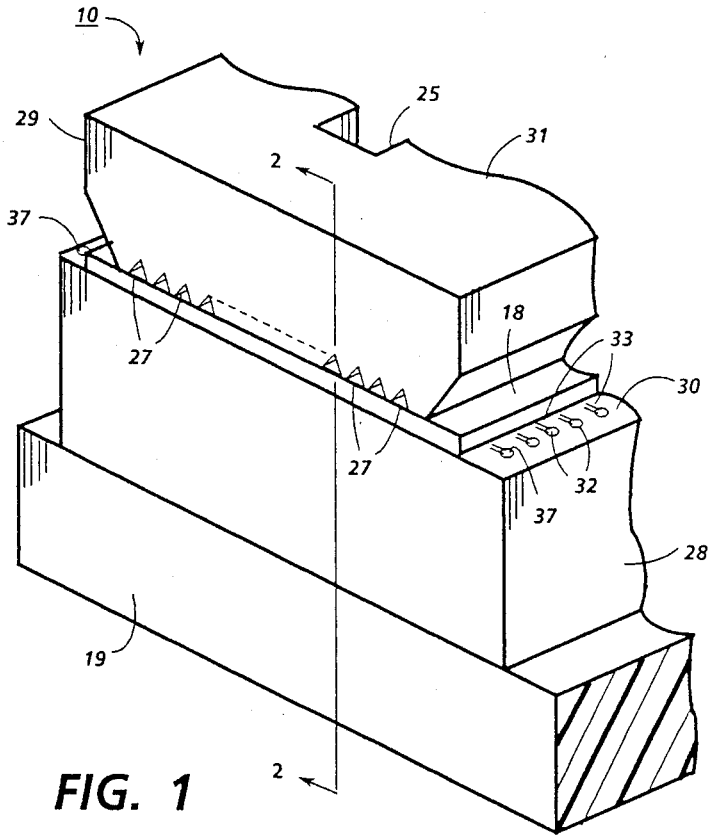
FIG. 1 is a schematic, partial isometric view of a typical printhead containing the improved heating elements of the present invention.
Figure 2:
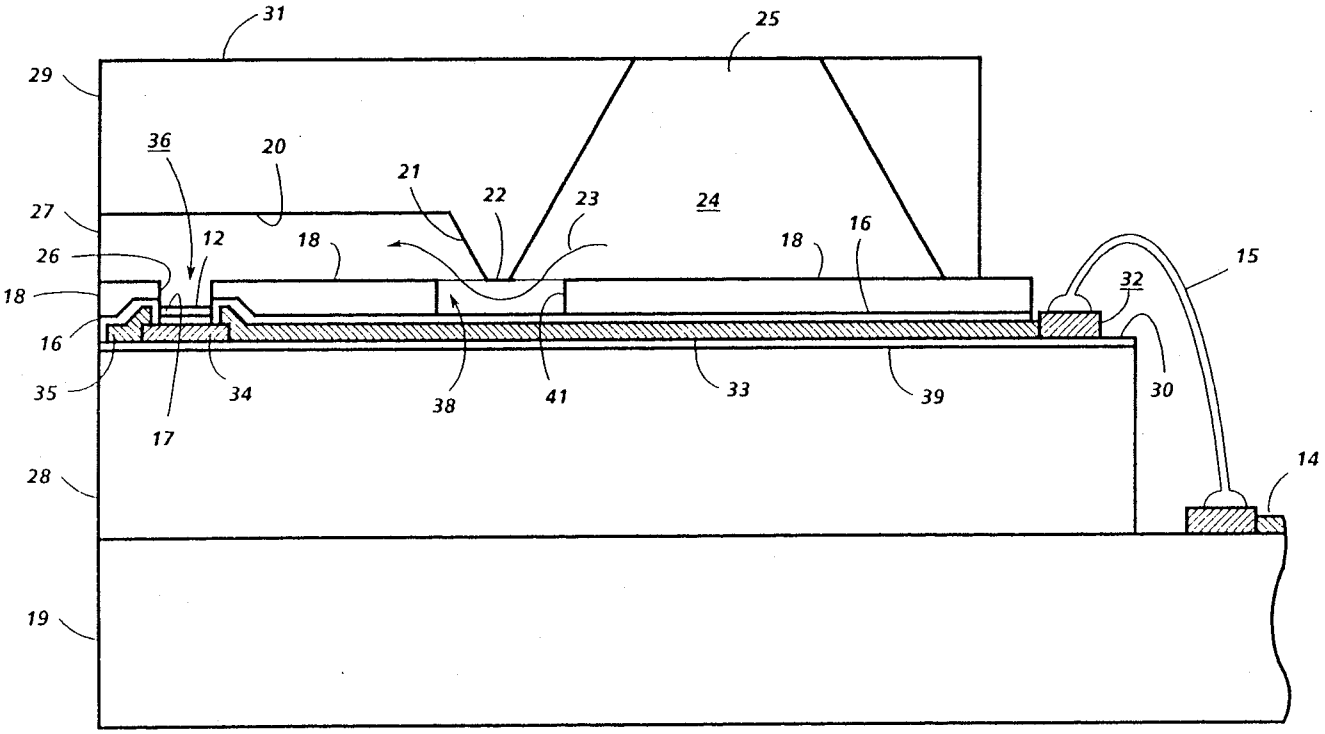
FIG. 2 is a cross sectional view of the printhead as viewed along view line 2—2 of FIG. 1.

An enlarged, schematic isometric view of the front face 29 of a typical thermal ink jet printhead 10, showing an array of droplet emitting nozzles 27, is depicted in FIG. 1. Referring also to FIG. 2, discussed later, the lower electrically insulating substrate or heater plate 28 has the improved multi-layered, thermal transducers 36 of the present invention, including the heating elements 34 and addressing electrodes 33 patterned on surface 30 thereof, while the upper substrate or channel plate 31 has parallel grooves 20 which extend in one direction and penetrate through the upper substrate front face edge 29. The other end of grooves terminate at slanted wall 21. The internal recess 24, which is used as the ink supply manifold for the capillary filled ink channels 20, has an open bottom 25 for use as an ink fill hole. The surface of the channel plate with the grooves are aligned and bonded to the heater plate 28, so that a respective one of the plurality of heating elements 34 is positioned in each channel, formed by the grooves and the lower substrate or heater plate. Ink enters the manifold formed by the recess 24 and the lower substrate 28 through the fill hole 25 and, by capillary action, fills the channels 20 by flowing through an elongated recess 38 formed in the thick film insulative layer 18. The ink at each nozzle forms a meniscus, the surface tension of which, together with the slight negative pressure of the ink supply, prevents the ink from weeping therefrom. The addressing electrodes 33 on the lower substrate or heater plate 28 terminate at terminals 32. The upper substrate or heater plate 31 is smaller than that of the lower substrate in order that the electrode terminals 32 are exposed and available for wire bonding 15 to the electrodes 14 on the daughter board 19, on which the printhead 10 is permanently mounted. Layer 18 is a thick film passivation layer, discussed later, sandwiched between upper and lower substrates. This layer is etched to expose the heating elements, thus placing them in a pit 26, and is etched to form the elongated recess 38 to enable ink flow between the manifold 24 and the ink channels 20. In addition, the thick film insulative layer is etched to expose the electrode terminals.

A cross sectional view of FIG. 1 is taken along view line 2—2 through one channel and shown as FIG. 2 to show how the ink flows from the manifold 24 and around the end 21 of the groove 20 as depicted by arrow 23. As is disclosed in U.S. Pat. No. 4,638,337 to Torpey et al, a plurality of sets of bubble generating heating elements 34 and their addressing electrodes 33 are patterned on the polished surface of a single side polished (100) silicon wafer. Prior to patterning the multiple sets of printhead electrodes 33, the resistive material that serves as the heating elements, and the common return 35, the polished surface 30 of the wafer is coated with an underglaze layer 39 such as silicon dioxide, having a thickness of about 2 micrometers. The resistive material may be a doped polycrystalline silicon which may be deposited by chemical vapor deposition (CVD) or any other well known resistive material such as zirconium boride ($ZrB_2$). The common return and the addressing electrodes are typically aluminum leads deposited on the underglaze and over the edges of the heating elements. The common return terminals 37 (FIG. 1) and addressing electrode terminals 32 are positioned at predetermined locations to allow clearance for wire bonding to the electrodes 14 of the daughter board 19, after the channel plate 31 is attached to make a printhead. The common return 35 and the addressing electrodes 33 are deposited to a thickness of 0.5 to 3 micrometers, with the preferred thickness being 1.5 micrometers.

Figure 3:
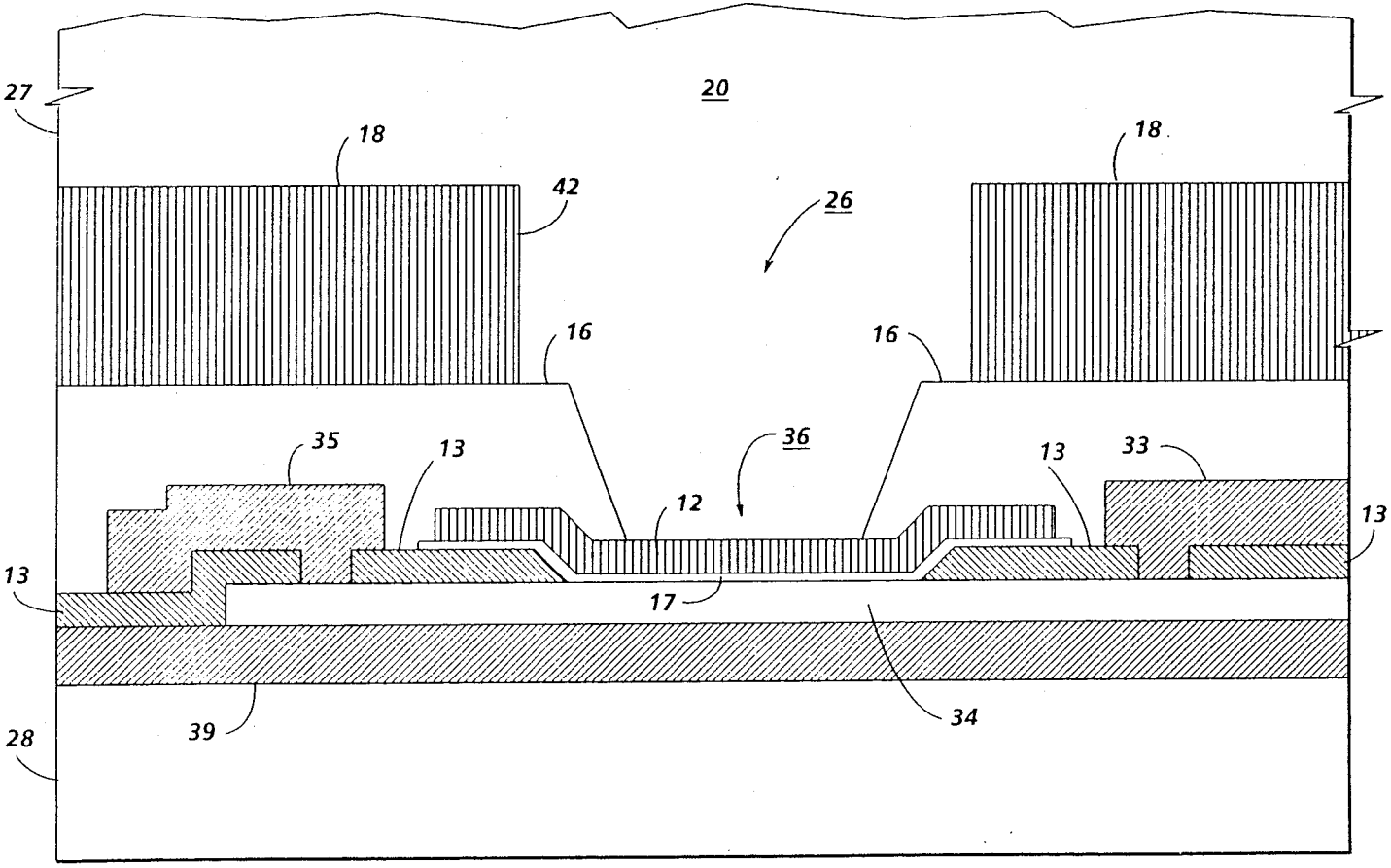
FIG. 3 is an enlarged, cross-sectional view of the ink channel, nozzle, and heating element of the present invention.

In FIG. 3, the improved thermal transducer 36 of the present invention is shown in an enlarged, cross-sectional view adjacent the nozzle end of the ink channel 20. In the preferred embodiment, the lower substrate or heater plate 28 is silicon with an underglaze layer 39 of thermal oxide or other suitable insulative layer such as silicon dioxide. Polysilicon heating elements 34 are formed and another insulative overglaze layer 13 is deposited over the underglaze layer and heating elements thereon. This overglaze layer 13 may be either silicon dioxide thermal oxide or a composite layer of thermal oxide followed by reflowed phosphosilicate glass (PSG). The thermal oxide layer is typically grown to a thickness of 0.5 to 1.0 micrometer to protect and insulate the heating elements. Reflowed PSG and thermal oxide composite is usually about 0.5 to 1.0 micrometer thick. In the case of the composite, the thin thermal oxide is followed by about a 5000 Å PSG layer, and then the PSG layer is heated subsequent to deposition to reflow the PSG glass and create a planarized surface. The planarized glass surface is more easily covered by aluminum metallization. The overglaze layer is masked and etched to produce vias therein near the edges of the heating elements for subsequent electrical interface with the aluminum (Al) addressing electrode 33 and Al common return electrode 35. In addition, the overglaze layer 13 in the bubble generating region of the heating element 34 is concurrently removed.

The next process step in fabricating the thermal transducer is to deposit a pyrolytic silicon nitride layer 17 having a thickness of about 1500 Å directly on the exposed polysilicon heating elements, followed by the deposition of a 0.1 to 1.0 micrometer thick tantalum layer 12 for cavitational stress protection of the pyrolytic silicon nitride layer 17. The pyrolytic nitride layer is 500 Å to 2500 Å thick, and, optimally, about 1500 Å thick.

The pyrolytic silicon nitride material is deposited on the thermal ink jet resistor elements from the reaction of ammonia ($NH_3$) and dichlorosilane ($SiCl_2H_2$) at about 800° C. or from silane and ammonia at a slightly lower temperature. The process utilizes a surface catalyzed reaction of the two gases which flow into a reaction chamber or tube (not shown) and over the wafers or heater plates which are stacked upon 3/16 inch spacing and about 100 wafers can fit in one run. Numerous heater plates can be obtained from one wafer as disclosed in U.S. Re. No. 32,572 to Hawkins et al. Because of the high deposition temperature involved, the hydrogen and Cl which are by-products of the reaction are not readily incorporated into the film or layer 17, so pyrolytic nitride can approach the properties of bulk silicon nitride. The primary properties of silicon nitride which are desirable are high thermal conductivity, resistance to mobile ion penetration (such as $Na^+$ and $Li^+$), high dielectric strength, and hardness. The pyrolytic nitride deposition process is the basis of local oxidation of silicon (LOCOS), so the process has been refined to the point where many wafers can be coated with a very low defect density silicon nitride dielectric with close uniformity control.

The pyrolytic nitride deposition process has the disadvantage that it is not compatible with Al metallized wafers, because Al melts at 675° C. and because even below the melting point, there is strong interaction between Si and Al, leading to junction spiking and other serious problems. Plasma silicon nitride used in prior art printheads has been developed to passivate metallized integrated circuit chips against alkali ions. The process uses silane and ammonia together with RF plasma excitation to deposit $SiN_xH_y$ plasma nitride at temperatures as low as 100° C. The low deposition temperature means that there is substantial hydrogen in the film which can migrate out and possibly cause Ta embrittlement as well as shifts in the polysilicon sheet resistance because of silicon grain boundary passivation by hydrogen evolved from the plasma nitride layer. In addition, because it is difficult to control RF power density, $SiH_4$ and $NH_3$ gas composition all at once, there is usually more thickness and compositional non-uniformity in plasma nitride. The departure of plasma nitride from ideal structure leads to higher mobile ion penetration, lower thermal conductivity, and some difficulty in achieving precise control. All of the problems with the plasma enhanced silicon nitride is eliminated by the use of pyrolytic silicon nitride.

The pyrolytic silicon nitride serves two very useful functions. First, it has very good thermal conductivity, so that it produces a thermally efficient resistor structure when deposited directly in contact with the resistor. Secondly, it is one of few materials that is resistant to Ta etches. Since Ta stands up well to most corrosive, high temperature environments, it is only reasonable that it is difficult to etch the material. The most well known wet chemical Ta etches are hot concentrated caustic solutions and $HF/HNO_3$ mixtures. Pyrolytic silicon nitride is etched very slowly by these etches, the etch rate being less than 50 Å per minute, so that the pyrolytic silicon nitride is negligibly etched or attached by the Ta etches. Therefore, Ta can be wet etched off pyrolytic silicon nitride ($Si_3N_4$) using simple photoresist masking and $HF/HNO_3$ mixtures. Alternatively, the Ta can be plasma etched using fluorine or chlorine based etch chemistry. The Ta can then serve as a mask for wet or plasma etch delineation of pyrolytic $Si_3N_4$ in boiling (180° C.) phosphoric acid.

The process flow for power MOS circuits is shown below in Table I with the resistor protection processing with pyrolytic silicon nitride and Table II without it. As can be seen, the pyrolytic nitride and Ta passivation are easily integrated into the process sequence. It is only necessary to add the pyrolytic nitride and Ta deposition steps, a single lithography step, and Ta and nitride etch steps.

The multi-layered, thermal transducer structure is completed with either 4 wt % CVD PSG or preferably, plasma nitride lead passivation of the transducer. Either of these materials can be selectively etched off the Al bonding pads and resistor area.

TABLE I

| Process Sequence for for Active Drivers With a Pyrolytic Silicon Nitride Protected Resistor | |
|---|---|
| 1. | Etch contact vias in reflow glass/thermal oxide |
| 2. | Clean |
| 3. | Deposit $Si_3N_4$ |
| 4. | Deposit Ta |
| 5. | Apply and pattern photoresist |
| 6. | Etch Ta |
| 7. | Strip photoresist |
| 8. | Etch $Si_3N_4$ |
| 9. | Clean |
| 10. | Deposit Al/1% Si |
| 11. | Pattern Al/1% Si |

TABLE II

| Process Sequence for Active Drivers Without a Pyrolytic Silicon Nitride Protected Resistor | |
|---|---|
| 1. | Etch contact vias in reflow glass/thermal oxide |
| 2. | Deposit Al/1% Si |
| 3. | Pattern Al/1% Si |

For electrode passivation, a 1.25 micrometer thick phosphorous doped CVD silicon dioxide film 16 is deposited over the entire heater plate or wafer surface, including the plurality of sets of heating elements and addressing electrodes. The passivation film 16 protects the exposed electrodes from the ink. Other ion barriers may be used, such as, for example, polyimide, plasma nitride, as well as the above-mentioned phosphorous doped silicon dioxide, or any combinations thereof. An effective ion barrier layer is achieved when its thickness is between 1000 angstrom and 10 micrometers, with the preferred thickness being 1 micrometer. The passivation film or layer 16 is etched off of the terminal ends of the common return and addressing electrodes for wire bonding later with the daughter board electrodes. This etching of the silicon dioxide film may be by either the wet or dry etching method. Alternatively, the electrode passivation may be accomplished by plasma deposited silicon nitride ($Si_3N_4$).

Next, a thick film type insulative layer 18 such as, for example, Riston ®, Vacrel ®, Probimer 52 ®, or polyimide, is formed on the passivation layer 16 having a thickness of between 10 and 100 micrometers and preferably in the range of 25 to 50 micrometers. The insulative layer 18 is photolithographically processed to enable etching and removal of those portions of the layer 18 over each heating element (forming recesses 26), the elongated recess 38 for providing ink passage from the manifold 24 to the ink channels 20, and over each electrode terminal 32, 37. The elongated recess 38 is formed by the removal of this portion of the thick film layer 18. Thus, the passivation layer 16 alone protects the electrodes 33 from exposure to the ink in this elongated recess 38.

In thick film layer 18, the pit 26 is formed having walls 42 that exposes each bubble generating area of the multi-layered thermal transducer 36 and walls 41 defining an elongated recess 38 to open the ink channels to the manifold. The recess walls 42 inhibit lateral movement of each bubble generated by the pulsed heating element which lie at the bottom of recesses 26, and thus promote bubble growth in a direction normal thereto. Therefore, as disclosed in U.S. Pat. No. 4,638,337, the blowout phenomena of releasing a burst of vaporized ink which causes an ingestion of air is avoided.

The passivated addressing electrodes are exposed to ink along the majority of their length and any pin hole in the normal electrode passivation layer 16 exposes the electrode 33 to electrolysis which would eventually lead to operational failure of the heating element addressed thereby. Accordingly, an added protection of the addressing electrode is obtained by the thick film layer 18, since the electrodes are passivated by two overlapping layers, passivation layer 16 and a thick film layer 18.

As disclosed in U.S. Pat. Nos. Re. 32,572 and 4,638,337 incorporated herein by reference, the channel plate is formed from a (100) silicon wafer to produce a plurality of upper substrates 31 for the printhead. The heater plate or heating element plate 28 is also obtained from a wafer or wafer sized structure (not shown) containing a plurality thereof. Relatively large rectangular through recesses and a plurality of sets of equally, spaced parallel V-groove recesses are etched in one surface of the wafer (not shown). These recesses will eventually become the ink manifolds 24 and ink channels 20 of the printheads. The channel plate and heating element plate containing wafers are aligned and bonded together, then diced into a plurality of individual printheads. One of the dicing cuts produces end face 29, and opens one end of the elongated V-groove recesses 20 producing nozzles 27. The other ends of the V-groove recesses 20 remain closed by end 21. However, the alignment and bonding of the above-mentioned wafers places the ends 21 of each set of channels 20 directly over elongated recess 38 in the thick film insulative layer 18 as shown in FIG. 2, enabling the flow of ink into the channels from the manifold 24 as depicted by arrow 23.

In the prior art heater plate fabricating processes, the resistors are formed first, followed by the aluminum electrodes, then a plasma nitride passivating layer is formed at about 400° C., and finally the tantalum cavitational stress protecting layer is deposited and delineated. This invention also enables improved heating element transducers using plasma nitride because the metal (aluminum) electrodes are formed after the resistors are passivated, so that the process temperature of the passivating plasma nitride layer can be raised from about 400° C. to about 600° C. After the Ta layer is delineated, the aluminum leads are patterned and passivated. Thus, by changing the order of the metallization, higher process temperatures are possible for the plasma nitride, thereby greatly enhancing its properties. Once the aluminum is deposited, subsequent processing temperatures are limited to about 400° C.

Unfortunately, plasma nitride deposition at about 400° C. characteristically have relatively high hydrogen content (from the outgases) which changes the resistor value, potentially embrittles the Ta layer, and degrades the plasma nitride thermal conductivity. Further, the defect density for thin films of plasma nitride (about 1500 Å) range from moderate to high and the thickness control is around ±5% because of heating nonuniformity across a general wafer load size of 100 wafers. By merely increasing the plasma nitride processing temperature to about 600° C., the hydrogen content is dropped from high to low. This cannot be done, of course, unless the aluminum is deposited after the plasma nitride, or extensive electrode degradation occurs. Optimally, pyrolytic nitride is used to improve the thickness control to about 2%, drop the hydrogen content to negligible amounts, and greatly improve the defect density. A comparison of the three resistor passivating layers is shown in Table III below.

TABLE III

| Parameters | Plasma Nitride | Plasma Nitride | Pyrolytic Nitride |
|---|---|---|---|
| Process Temperature | about 400° C. | about 600° C. | about 800° C. |
| Hydrogen Content (in outgases) | High | Low | Negligible |
| Problems Caused by Hydrogen | •Resistor value changes •Ta embrittlement •Degrades thermal conductivity | Minor or None | None |
| Load Size | 100 wafers | 100 wafers | 100 wafers |
| Defect Density for Thin Films (about 1500Å) | Moderate to High | Moderate to High | Low |
| Thickness Control (based on heating uniformity) | about ± 5% | about ± 5% | about ± 2% |

The transducers of the present invention enable any Ta delineation method and any pyrolytic nitride delineation. That is, after pyrolytic nitride deposition followed by Ta deposition, the Ta may be delineated through a patterned photoresist by either a wet or dry (plasma) etch. The photoresist may be stripped and, using the Ta as a mask, the pyrolytic nitride etched in, for example, a $H_3PO_4$ etch. Alternatively, the pyrolytic nitride may be plasma etched, using the same Ta photoresist mask, and then the photoresist removed. Thus, either an all wet, all dry, or combination of wet and dry etching processes may be used.

Many modifications and variations are apparent from the foregoing description of the invention, and all such modifications and variations are intended to be within the scope of the present invention.

We claim:

1. An improved thermal ink jet printhead of the type having a plurality of ink channels with each containing a multi-layered thermal transducer therein, an ink reservoir, and a plurality of ink droplet emitting nozzles, said channels being in communication with the reservoir and the nozzles, so that ink fills the channels and selective application of electrical pulses representing digitized data to the thermal transducers momentarily vaporize the ink in contact therewith producing temporary bubbles which eject and propel ink droplets from the nozzles to a recording medium, wherein the improvement comprises:

said thermal transducers each having a bubble-generating resistive layer, an insulative layer deposited over the resistive layer and patterned to remove the insulative layer in a region whereat bubbles are to be produced by said electrical pulses and at opposing edges thereof for providing locations for interface with an addressing electrode and a common return electrode, a high temperature silicon nitride layer deposited over the insulative layer and exposed bubble generating and electrode interface regions of the resistive layer, said high temperature silicon nitride layer being deposited at a temperature of at least about 600° C. or more and being located intermediate the opposing exposed edges of the resistive layer and spaced therefrom, the high temperature silicon nitride layer having a reduced hydrogen content and a predetermined relatively thin thickness to electrically isolate a subsequently formed cavitational stress protecting layer deposited thereon and delineated by an etching process, which low hydrogen content and relatively thin thickness of the high temperature silicon nitride layer improves the thermal efficiency and durability of the thermal transducers of the printhead, while said insulative layer combined with the high temperature silicon nitride layer increases the insulating spacing between the edges of the protecting layer and the resistive layer.

2. The printhead of claim 1 wherein the high temperature silicon nitride layer is pyrolytic silicon nitride deposited at a temperature of about 800° C. and the predetermined thickness of the pyrolytic silicon nitride layer is about 1500 Å, the pyrolytic silicon nitride producing substantially no hydrogen and providing a thickness control of ±2%; and wherein the cavitational stress protecting layer is tantalum.

3. The printhead of claim 2, wherein the insulative layer is silicon dioxide thermal oxide having a thickness of 0.5 to 1.0 μm.

4. The printhead of claim 2, wherein the insulative layer is a composite layer comprising a layer of thermal oxide followed by a layer of phosphosilicate glass (PSG) the thickness of the thermal oxide layer being about 0.5 to 1.0 μm and the thickness of the PSG layer being about 5000 Å.

5. The printhead of claim 4, wherein the PSG layer is heated subsequent to deposition to reflow the PSG layer and create a planarized surface, which is more easily covered by a subsequent metallization step which produces the addressing and common return electrodes.

6. The printhead of claim 1 wherein the high temperature silicon nitride layer is plasma deposited silicon nitride deposited at about 600° C., and the predetermined thickness of the plasma deposited silicon nitride layer is about 1500 Å, so that the hydrogen content of the plasma nitride is reduced by the high deposition temperature, thereby reducing problems caused by hydrogen in the adjacent contacting layers of the thermal transducer.

7. A method of fabricating an improved printhead for use in an ink jet printing device, comprising the steps of:

(a) forming equally spaced, linear array of resistive material on a surface of a substrate for use as heating elements, the resistive material array each having a top surface;

(b) depositing and patterning an insulative layer of predetermined thickness over the substrate and resistive material array, so that the insulative layer is removed from the top surface of each of the resistive material at opposing edge portions and at a region located between the opposing edge portions for subsequent use respectively as electrical interface with addressing electrode and common return electrode and as a bubble generating region;

(c) depositing a layer of silicon nitride over the insulative layer and exposed surface areas of the resistive material at a deposition temperature of at least about 600° C. to reduce hydrogen content therein, the silicon nitride layer having a relatively thin predetermined thickness;

(d) depositing and patterning a tantalum (Ta) layer of predetermined thickness on the silicon nitride layer by wet chemical or dry plasma Ta etch the patterned tantalum layer covering bubble generating region of the resistive material and surrounding portion of the insulative layer intermediate the electrode and common return electrode interface locations at the edge portions of the resistive material;

(e) using the patterned tantalum layer as a mask and delineating the silicon nitride layer, so that the bubble generating region of the resistive material and a peripheral edge portion of the insulative layer surrounding the bubble generating region are covered by the silicon nitride and Ta layer the silicon nitride layer being removed from the substrate surface except for those portions under the Ta layer, whereby the outer edge portions of the Ta layer are spaced from the resistive material by both the insulative layer and the silicon nitride;

(f) forming and passivating a pattern of addressing and return electrodes on the same surface of the substrate for enabling individual addressing of each heating element with electrical pulses; and (g) aligning and bonding the substrate to an ink flow directing channel stucture having a plurality of channels therein, with each channel having an open end, so that each channel contains a heating element therein spaced a predetermined distance from the channel open ends.

8. The fabricating method of claim 7, wherein the ink flow directing structure is a (100) silicon substrate, and wherein the method further comprises the steps of anisotropically etching the (100) silicon substrate to form etched recesses in one surface thereof which will subsequently serve as ink manifold and parallel channels, one end of the channels communicate with the manifold and the other ends are open to serve as droplet expelling nozzles.

9. The fabricating method of claim 7, wherein the silicon nitride layer is in step (c) pyrolytic silicon nitride deposited at a temperature of about 800° C. to a thickness of between 500 to 2500 Å.

10. The fabricating method of claim 9, wherein the depositing of the pyrolytic silicon nitride layer at step (c) is accomplished from a reaction of ammonia and silane or dichlorosilane gases in a reaction chamber at about 800° C. for a period of time to achieve a preferred thickness of about 1500 Å.

11. The fabricating method of claim 7, wherein the silicon nitride layer in step (c) is plasma deposited silicon nitride at a temperature of about 600° C. to a thickness of about 1500 Å.

* * * * *